US006959564B2

(12) United States Patent
Miller, III

(10) Patent No.: US 6,959,564 B2
(45) Date of Patent: Nov. 1, 2005

(54) PANTY CONSTRUCTION WITH MOISTURE MANAGEMENT LINER

(75) Inventor: Robert A. Miller, III, New Ringgold, PA (US)

(73) Assignee: Sara Lee Corporation, Winston-Salem, NC (US)

( * ) Notice: Subject to any disclaimer, the term of this patent is extended or adjusted under 35 U.S.C. 154(b) by 282 days.

(21) Appl. No.: 10/403,541

(22) Filed: Mar. 31, 2003

(65) Prior Publication Data

US 2004/0193136 A1 Sep. 30, 2004

(51) Int. Cl.[7] ..... A41B 9/02
(52) U.S. Cl. ..... 66/177
(58) Field of Search ..... 66/172 R, 175, 66/177, 178 R, 178 A, 171; 2/73, 78.2, 78.1, 2/239; 450/100, 102–104

(56) References Cited

U.S. PATENT DOCUMENTS

| | | | | |
|---|---|---|---|---|
| 364,779 | A | 6/1887 | Seymour | |
| 1,103,589 | A | 7/1914 | Kellner et al. | |
| 3,424,162 | A | 1/1969 | Parravicini | 128/288 |
| 4,031,568 | A | 6/1977 | Huff | 2/406 |
| 4,067,068 | A | 1/1978 | Bregstein et al. | 2/406 |
| 4,227,531 | A | 10/1980 | McLeod | 128/288 |
| 4,236,257 | A | 12/1980 | Williams et al. | 2/406 |
| 4,237,707 | A | 12/1980 | Safrit et al. | 66/172 E |
| 4,244,059 | A | 1/1981 | Pflaumer | 2/400 |
| 4,487,040 | A | 12/1984 | Patel et al. | 66/195 |
| 4,722,202 | A | 2/1988 | Imboden | 66/177 |
| 4,875,241 | A | 10/1989 | Browder, Jr. et al. | 2/409 |
| 5,152,014 | A | 10/1992 | Marx et al. | 2/406 |
| 5,198,288 | A | 3/1993 | Grunfeld | 428/253 |
| 5,203,185 | A | 4/1993 | Okuno | 66/171 |
| 5,226,179 | A | 7/1993 | Choi | 2/403 |
| 5,241,710 | A | 9/1993 | Lockhart | 2/406 |
| 5,291,617 | A | 3/1994 | Moretz et al. | 2/400 |
| 5,297,296 | A | 3/1994 | Moretz et al. | 2/237 |
| 5,315,717 | A | 5/1994 | Moretz et al. | 2/400 |
| 5,398,346 | A | 3/1995 | Feinberg et al. | 2/400 |
| 5,414,870 | A | 5/1995 | Moretz et al. | 2/400 |
| 5,416,929 | A | 5/1995 | Braunstein | 2/406 |
| 5,435,014 | A | 7/1995 | Moretz et al. | 2/403 |
| 5,533,212 | A | 7/1996 | Moretz et al. | 2/409 |
| 5,546,607 | A | 8/1996 | Roberts | 2/406 |
| 5,759,662 | A | 6/1998 | Heiman | 428/85 |
| 5,855,123 | A * | 1/1999 | Albright | 66/177 |
| 5,888,914 | A | 3/1999 | Katz | 442/184 |

(Continued)

FOREIGN PATENT DOCUMENTS

| | | | |
|---|---|---|---|
| EP | 1 075 800 | 2/2001 | A41B 9/04 |

(Continued)

OTHER PUBLICATIONS

International Search Report (PCT/US2004/009235, dated Sep. 14, 2004).

*Primary Examiner*—Danny Worrell
(74) *Attorney, Agent, or Firm*—Womble Carlyle Sandridge & Rice, PLLC

(57) ABSTRACT

A panty construction having improved moisture management. The panty construction includes a body portion having a waist opening, a front section and a back section, a crotch section, and a panty liner. The panty liner is formed from a knitted fabric comprising alternating courses of hydrophilic yarns. The yarns are knitted to form a rib knit with parallel ribs, the parallel ribs formed parallel to the alternating courses. The panty liner overlies and is attached to the inner surface of the crotch area so that the parallel ribs are substantially parallel with the major axis of the crotch area.

38 Claims, 6 Drawing Sheets

U.S. PATENT DOCUMENTS

| | | | | |
|---|---|---|---|---|
| 5,906,876 | A | 5/1999 | Conway | 428/89 |
| 5,996,378 | A | 12/1999 | McCartney | 66/192 |
| 6,032,295 | A | 3/2000 | Marshall | 2/239 |
| 6,041,446 | A | 3/2000 | Braunstein et al. | 2/400 |
| 6,209,143 | B1 | 4/2001 | Hancock | 2/406 |
| 6,276,175 | B1 | 8/2001 | Browder, Jr. | 66/171 |
| 6,324,699 | B1 | 12/2001 | Cosmah | 2/239 |
| 6,341,505 | B1 | 1/2002 | Dahlgren | 66/185 |
| 2002/0012510 | A1 | 1/2002 | Jiang et al. | 382/123 |

FOREIGN PATENT DOCUMENTS

| | | | |
|---|---|---|---|
| FR | 2632163 | 12/1989 | A41B 9/00 |
| JP | 04041751 | 12/1992 | D04B 1/00 |

* cited by examiner

PANTY CONSTRUCTION WITH MOISTURE MANAGEMENT LINER

FIELD OF THE INVENTION

The present invention relates to the field of textile production, and, more particularly to a panty and panty liner construction having improved moisture management properties.

BACKGROUND OF THE INVENTION

Panty constructions are well known, and generally consist of a lower torso portion, or body, that defines a waist opening at its top, a pair of leg openings, and a crotch area connecting the front and back sections of the body.

For many years, panty constructions were formed almost entirely from materials such as cotton. It is well known that cotton is generally hydrophilic, and therefore, absorbs moisture. Cotton, however, deforms easily and, because it is relatively inelastic, it provides little support to the wearer.

In recent years, synthetic materials such as nylon, which have better stretchability than cotton, have become increasingly popular for forming panties. A problem inherent in such synthetic materials, however, is that they are generally hydrophobic and non-absorbent. Thus, body fluids are less likely to be absorbed by the garment and evaporated. Rather, moisture either remains in contact with the skin or passes through to the outer garments, neither of which is desirable.

It is well known to use panty liners to assist in moisture management. Such liners are typically made of moisture absorbent materials, such as cotton. Cotton liners, however, tend to saturate quickly and then retain the absorbed moisture in proximity to the wearer's skin, which is both uncomfortable and unsanitary.

Other attempts to solve the problem of management or removal of moisture from the crotch area have used multi-layer panty liner and crotch constructions. These multi-layer configurations typically include one or more of several types of layers, including porous non-absorbing layers, absorbent layers, and liquid impermeable middle or outer layers. More recent constructions have incorporated hydrophilic synthetic fiber yarns into vaporization and dispersal, multi-layer, constructions, or into bundled, matted constructions. In each case, however, these constructions have proven bulky, uncomfortable, unsightly, and only marginally effective. Additionally, such complex constructions have added significantly to the cost of constructing the panty.

SUMMARY OF THE INVENTION

One aspect of the present invention is directed to a panty construction having improved moisture management properties. The panty construction includes a body portion, and a panty liner with a structure that transports moisture away from the crotch section.

The body portion is a conventional construction comprising a waist opening at the top, a pair of leg openings, a front section, a back section, and a crotch section. The crotch section joins the front and back sections of the body of the panty and defines a major axis between the front and back sections. The crotch section has inner and outer surfaces, opposed side edges adjacent the leg openings, and opposed front and back edges adjacent the front and back sections, respectively. The body portion is conventionally knitted of yarns such as cotton, polyester, nylon, rayon, and combinations thereof.

The panty liner of the present invention has an inner surface and an outer surface, opposed side edges adjacent the leg openings, and opposed front and back edges adjacent the front and back sections, respectively. The panty liner is preferably formed from a knitted fabric comprising filamentary yarns having hydrophilic properties. Alternatively, the yarns can be spun or a combination of spun and filamentary yarns can be used in the fabric construction. The knitted structure may be either circular knitted or warp knitted.

The yarns used in knitting the panty liner are formed from a polymer such as polyester. The filaments forming the yarns have cross-sections that define longitudinally extending, outer channels for enhancing the absorption and movement of moisture away from the crotch. In one preferred embodiment, the yarns are treated with a finish that provides soil release and/or anti-microbial properties. The yarns are desirably knitted on either a 22 gauge or 28 gauge jersey knitting machine to form a liner having a ribbed construction; however, the gauge of the machine will be chosen based on the size of the yarns selected. Whereas conventional rib knits that are formed on these machines have ribs running parallel to the wales, the rib knit of the panty liner of the present invention has ribs that run parallel to the courses of the knitted fabric. This is accomplished by alternating two feeds of yarns having a selected size, followed by two feeds of filamentary yarns have a selected size either smaller or larger than the first two feeds; i.e., the knitted construction is formed of alternating pairs of yarns, the yarns in each pair being similarly dimensioned and either smaller or larger than the yarns in the preceding pair of yarns. When knitted in this manner, the final panty liner has a substantially flat inner (toward the wearer) face and a ribbed outer face (away from the wearer).

In constructing the panty, the panty liner is oriented with the ribs running parallel to the major axis of the panty crotch. Such an orientation creates wicking channels that assist the transport of moisture away from the crotch section and into the much larger front and rear sections of the panty body.

DETAILED DESCRIPTION OF THE PREFERRED EMBODIMENTS

Figure 1:
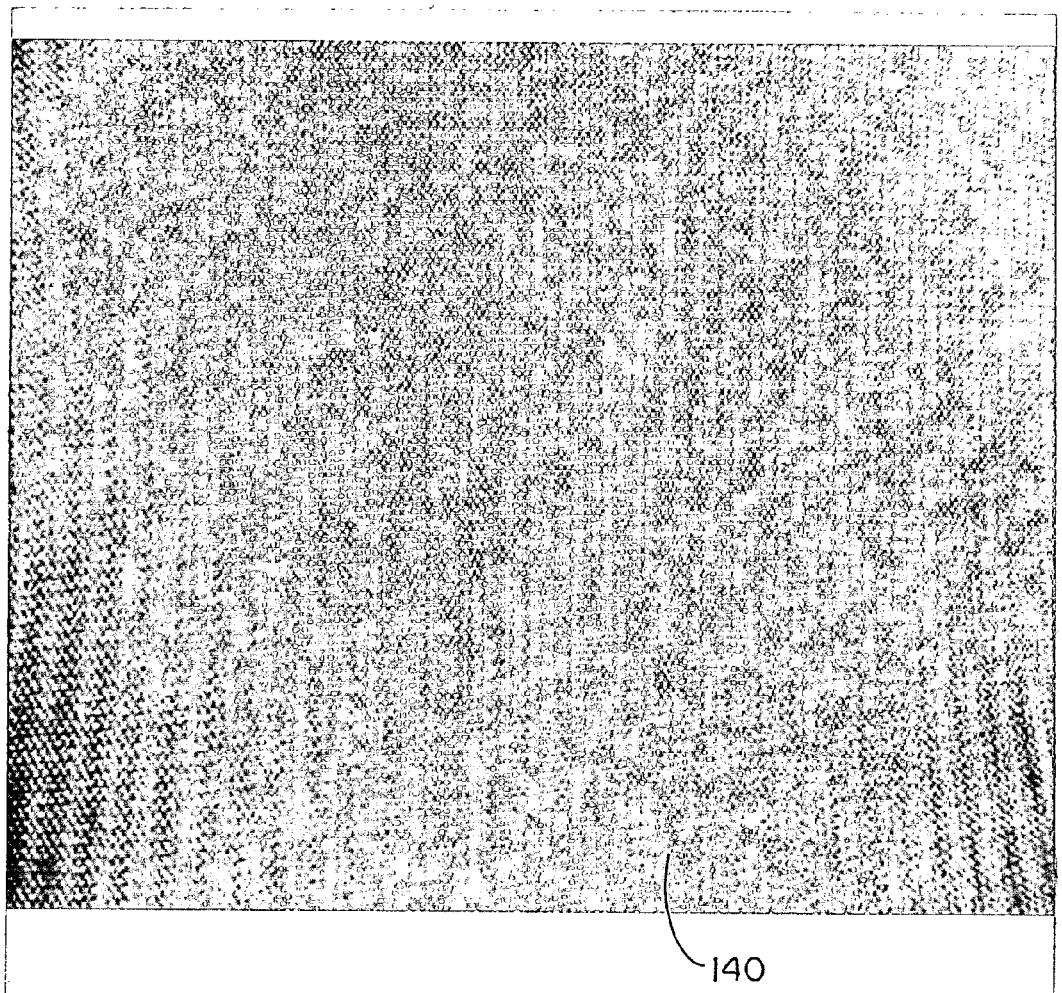
FIG. 1 is a photographic view of the panty liner construction of the present invention.
Figure 2:
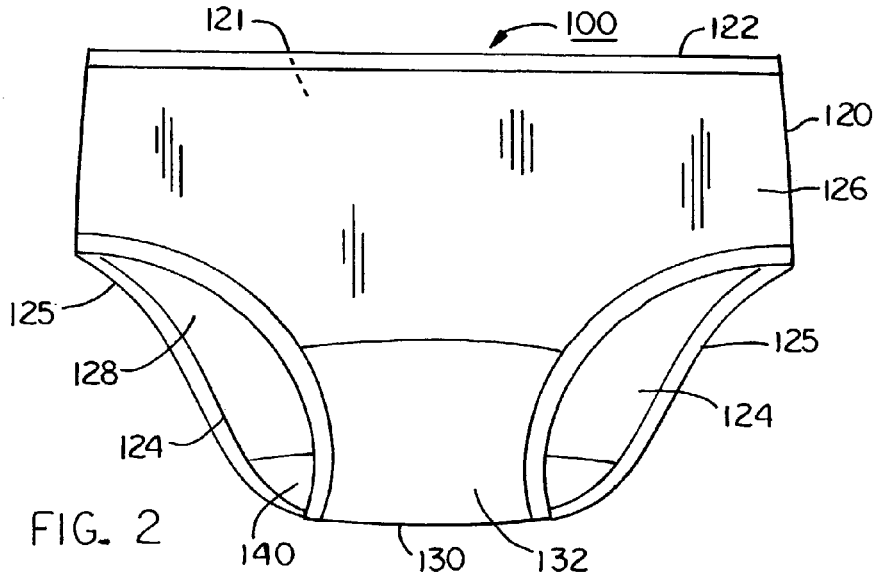
FIG. 2 is a front perspective view of the panty construction of the present invention.
Figure 3:
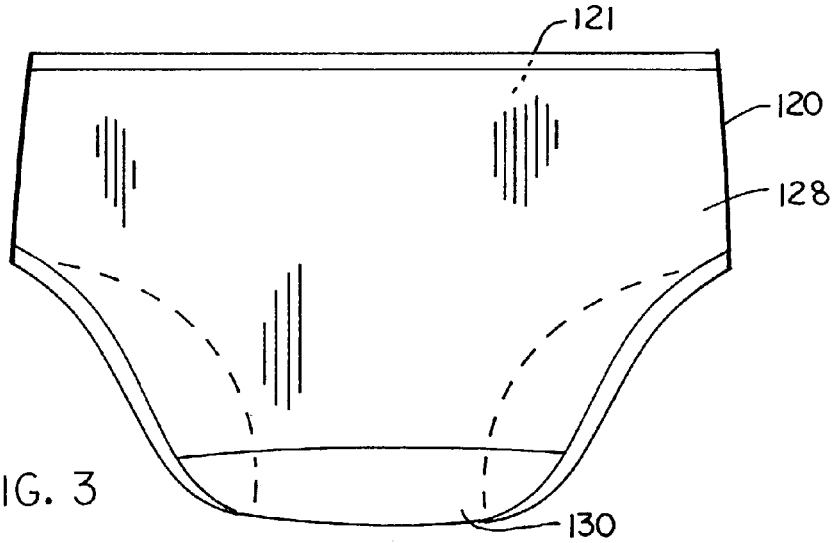
FIG. 3 is a rear perspective view of the panty construction of FIG. 2.

As shown in FIGS. 1 through 3, one embodiment of the present invention is directed to a panty construction having improved moisture management characteristics. Shown generally as 100, the panty construction comprises a body portion 120 and a panty liner 140.

The body portion 120 is conventionally constructed from one or more panels, or pieces, of fabric. The body portion 120 is preferably formed of 100 percent cotton yarns; however, polyester, nylon, rayon, and combinations or intimate blends thereof may also be used in constructing the body 120. The body portion 120 is also preferably knitted, but may be woven, depending upon the characteristics desired in the final constructed garment. When knitted, the body may be circular or warp knitted.

The body portion 120 shown in FIGS. 2 and 3 comprises a waist opening 121 at the top of the body, a pair of leg openings 124, a front section 126, a back section 128, and a crotch section 130. While each of these components of the body portion 120 would typically be formed of the same material, the invention is not limited thereto. Rather, each portion of the body could be formed from a different type of material; e.g., the front section 126 could be nylon and the back section 128 could be cotton, etc. As is typical in panty constructions, a waistband 122 including an elastomeric material may be sewn, or otherwise attached around the periphery of the waist opening 121. Similarly, elastomeric trim 125 may be affixed around the leg openings 124 to secure them snugly against the legs of the wearer.

Figure 4:
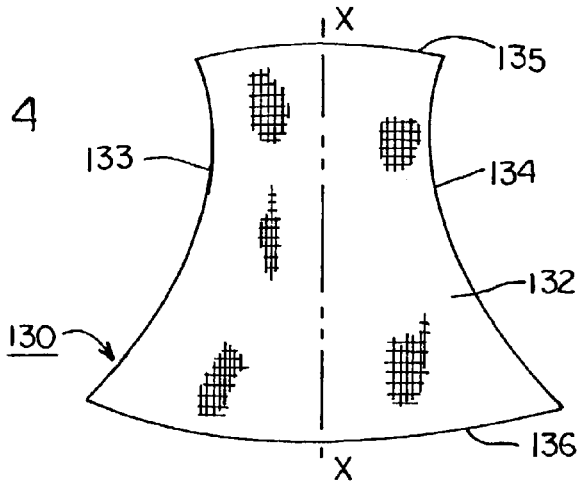
FIG. 4 is a top view of the crotch section of the panty construction of FIG. 2.
Figure 5:
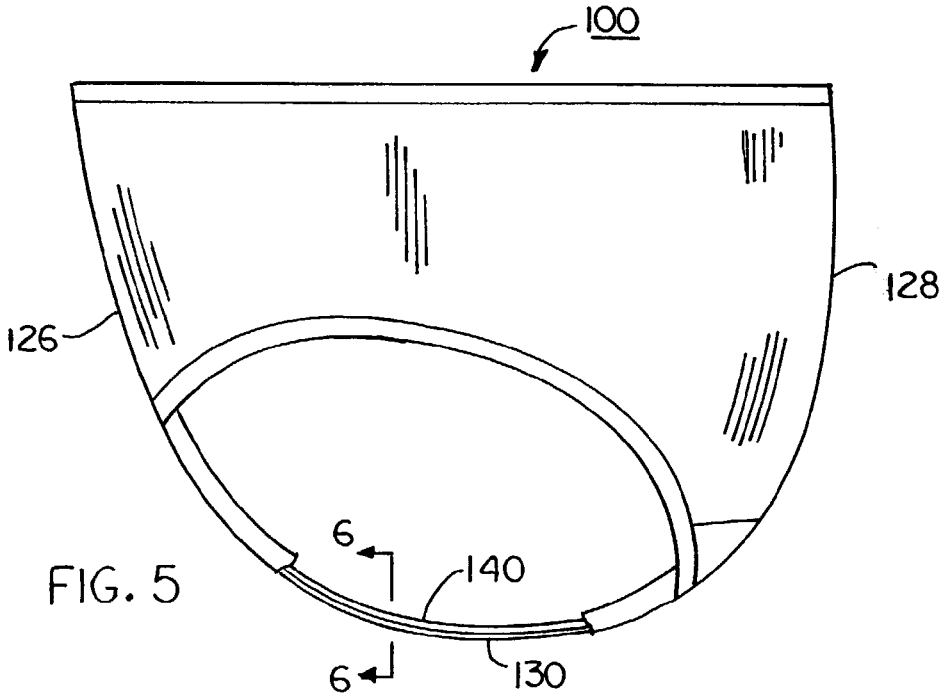
FIG. 5 is a side perspective view of the panty construction of FIG. 2.
Figure 6:
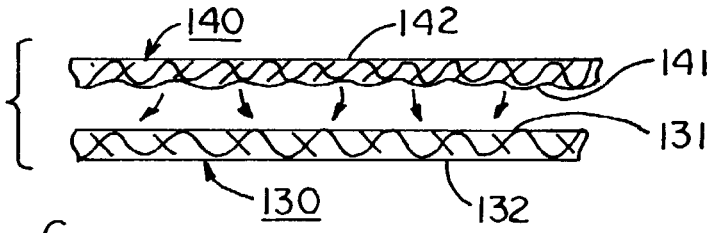
FIG. 6 is a cross-sectional view of the panty construction of FIG. 1 taken along Line 6—6 of FIG. 5.

The crotch section 130 is also formed from the same material, i.e., cotton, as the other components of the body portion 120. The crotch section 130 joins the front section 126 and the back section 128 and defines a major axis between the front 126 and back 128. The major axis is denoted as Line X—X in FIG. 4. As shown in FIGS. 4–6, the crotch section 130 has inner and outers surfaces 131, 132, opposed side edges 133, 134 adjacent the leg openings 124, and opposed front 135 and back 136 edges adjacent the front 126 and back 128 sections of the body 120. As is conventional in underwear, and panty, constructions, the crotch section 130 is stitched around its periphery to front section 126 and back section 128 along the front and back edges 135, 136 of the crotch section. Similarly, the opposed side edges 133, 134 are stitched at the leg openings 124.

While panty crotch constructions having dual layers for absorption and control of moisture are known in the art, the inner layer, or liner, is usually formed of the same material (cotton) as the crotch section 130, but typically is bulkier and thicker than the outer layer. The panty liner 140 of the present invention, however, is substantially different in both construction and functionality from the known constructions. The overall shape of the crotch section 130 and panty liner 140, however, are conventional.

Turning now to FIG. 6, there is shown a cross-sectional view of the panty construction of FIG. 2 taken along Line 6—6 of FIG. 5. As shown in FIG. 5, the crotch of panty 100 comprises crotch section 130 as the outer layer, and the panty liner 140 overlying crotch section 130 to form the inner layer of the construction. Better shown in the enlarged, exploded view of FIG. 6, the panty liner 140 overlies crotch section 130 with the outer surface 141 of the liner positioned adjacent the inner surface 131 of the crotch section 130. As will be explained in greater detail below, the outer 141 and inner 142 surfaces of the panty liner 140 have different textures and functions.

Figure 7:
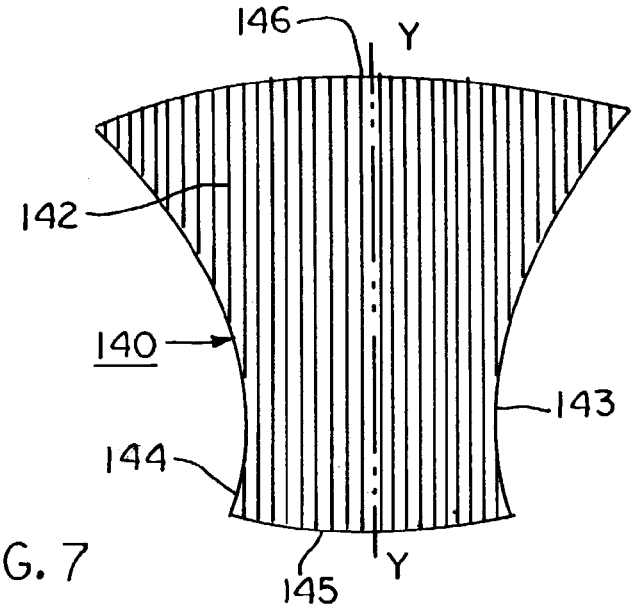
FIG. 7 is a bottom view of the panty liner construction of the present invention, illustrating the formation of ribs in the knitted fabric comprising the panty liner.

As illustrated by comparing FIGS. 4 and 7, the crotch section 130 and panty liner 140 are similarly shaped and dimensioned. Side edges 143, 144 of the panty liner 140 correspond to the side edges 133 and 134 of crotch section 130. Similarly, front 145 and back 146 edges of the panty liner 140 correspond respectively with front 135 and back 136 edges of the crotch section 130. Thus, when the panty liner 140 is positioned over the crotch section 130, the crotch section and panty liner are in substantial registration with one another. The panty liner 140 is also preferably stitched around its periphery to the periphery of the crotch section 130.

Figure 8:
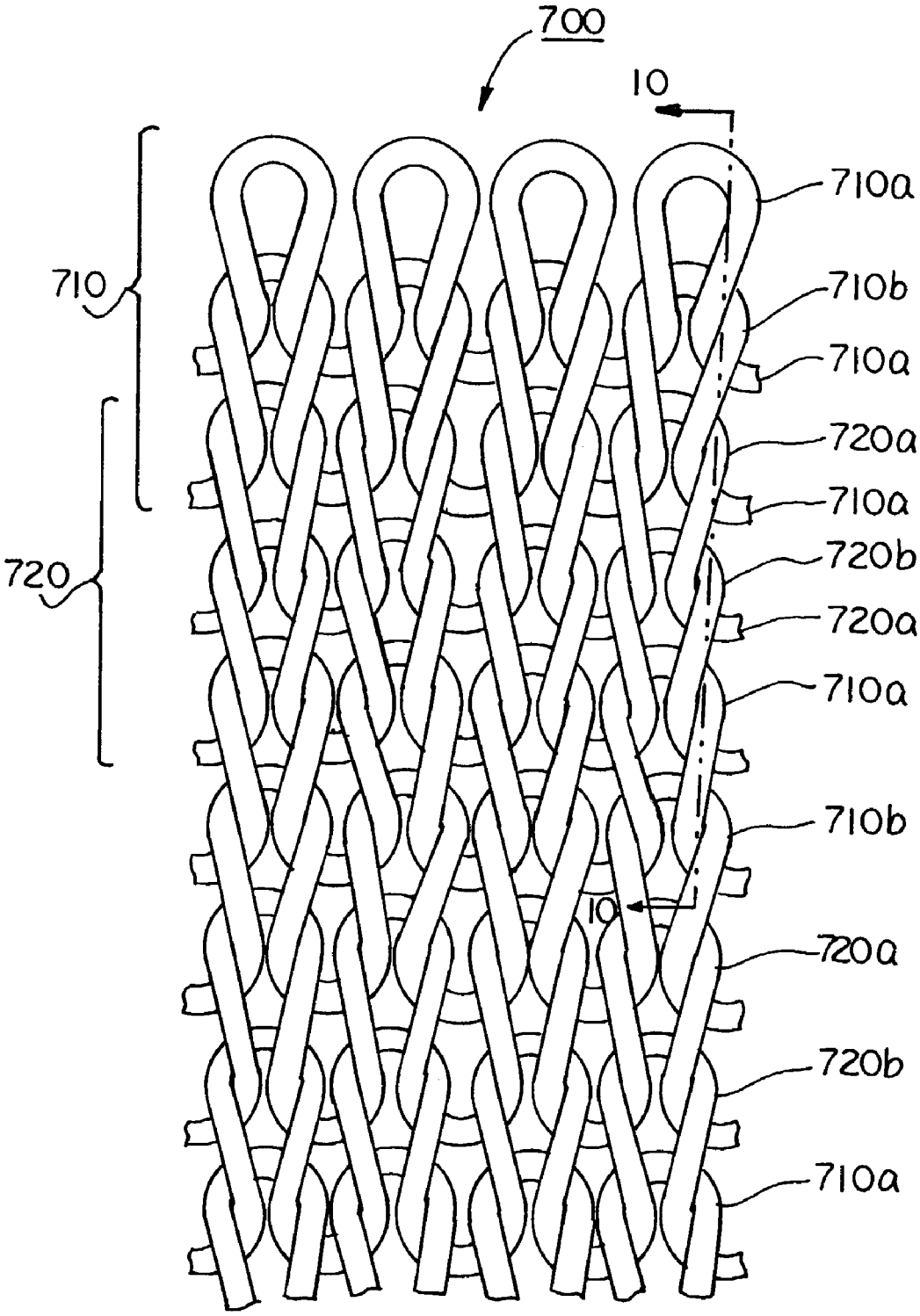
FIG. 8 is an enlarged view of the technical face of the knitted fabric comprising the panty liner of the present invention.
Figure 9:
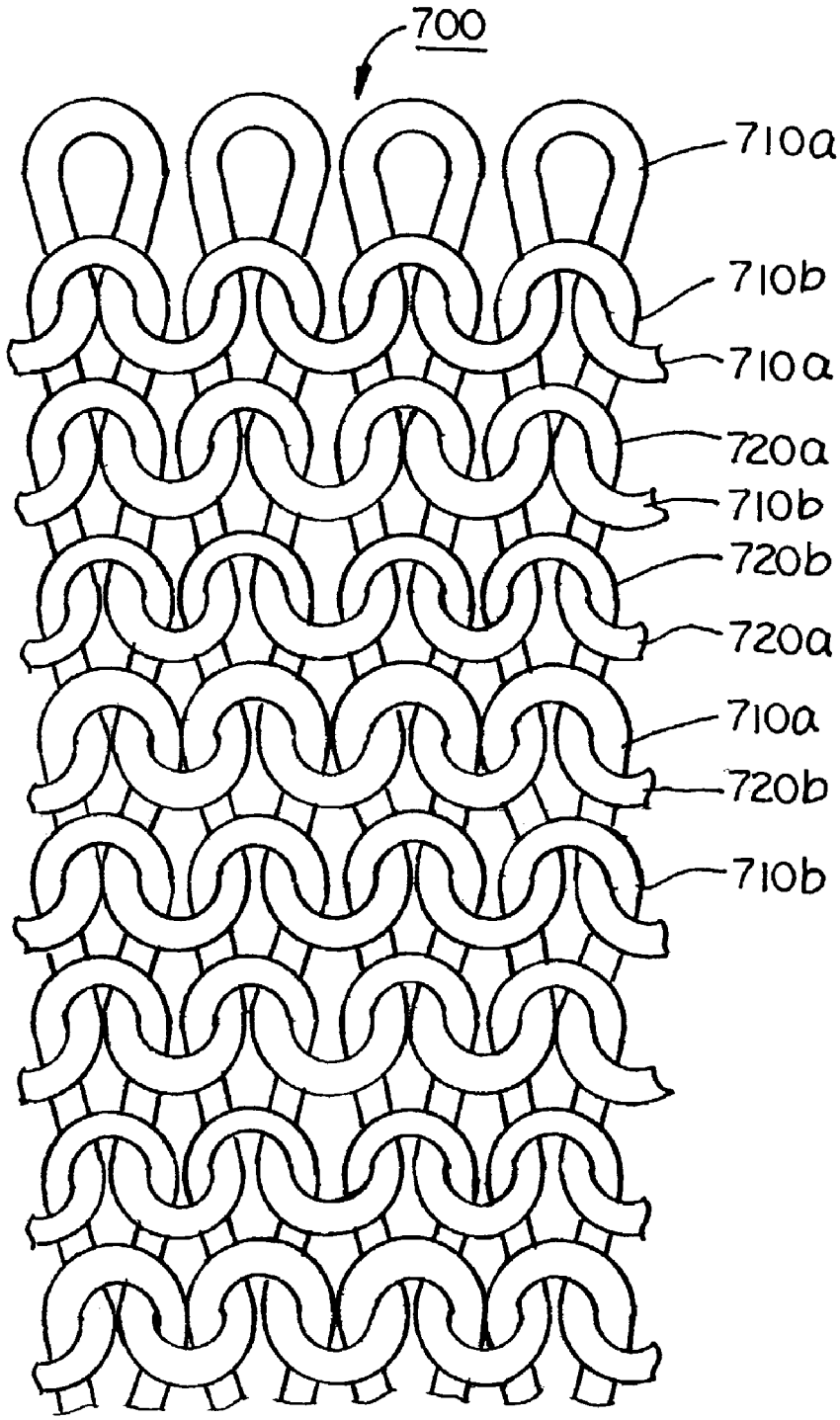
FIG. 9 is an enlarged view of the technical back of the knitted fabric comprising the panty liner of the present invention.

Turning now to FIGS. 8 and 9, an enlarged front perspective view of the knitted fabric of the panty liner is shown generally as 700. FIG. 8 is representative of the technical face of the fabric and FIG. 9 is representative of the technical back of the fabric. The panty liner 140 of the present invention is not formed from cotton, but is knitted from yarns formed from a polymer. One such yarn is available from DAK Americas in Charlotte, N.C. under the trademark HYDROTEC™. HYDROTEC™ is a spun yarn formed from staples of polyester filaments. The filaments from which the staples are obtained have a unique geometry whereby one or more channels extend longitudinally along the outer surfaces of the filaments. These channels enhance the absorption, transport, and release of moisture. Similarly, yarn spun from the staples absorbs and transports moisture longitudinally along the lengths (courses) of the yarns.

Figure 10:
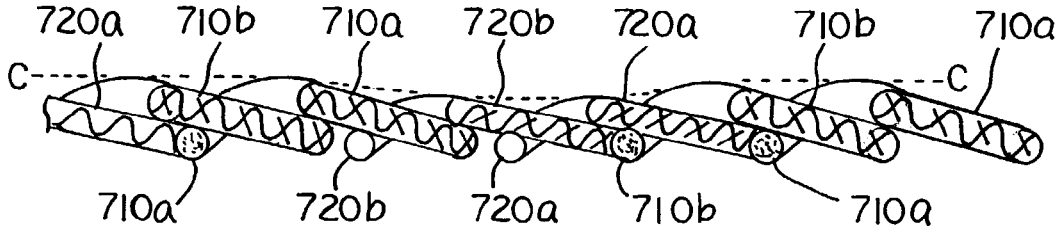
FIG. 10 is a cross-sectional view of the knitted fabric construction of the panty liner of FIG. 8 taken along Line 10—10.

While the polyester yarns, with their longitudinal channels, provide enhanced moisture control, I have found that the use of different sized yarns to form the knitted fabric, and the particular knitted fabric construction employed, will significantly improve the moisture management characteristics of the panty liner 140. As shown in FIG. 8, the knitted fabric 700 of the panty liner is formed by alternating feeds of yarns having different cross-sections. A first pair of yarns 710 having a first size is knitted, followed by a second pair of yarns 720 having a second size. Yarns 710*a* and 710*b* are similarly sized, as are yarns 720*a* and 720*b*. In one embodiment, yarns 710*a* and 710*b* are 30/1, and yarns 720*a* and 720*b* are 18/1. As mentioned above, all of the yarns are comprised of spun polyester staples such as those that are available from DAK Americas under the HYDROTEC™ trademark. By varying the sizes of the alternating yarn pairs, it has been found that additional moisture transport channels are created along the knitted courses of the fabric in the form of a ribbed structure. That is, the channeling geometries of the polyester filaments provide a first type of moisture transport channel, and the ribbed contour of the knitted courses creates "ridges" and "valleys" that form a second type of transport channel, as illustrated by Contour Line C—C in FIG. 10. While rib knits are conventionally formed to run parallel to the wales of the fabric, as shown in FIG. 10 the ribs of the knitted fabric described herein run parallel to the courses. Thus, the liner structure has been found to provide a larger dispersion area across the panty formed therefrom for moving moisture at a substantially greater rate than the filamentary channels of the yarns alone. While the knitted construction of the panty liner 140 could be formed in a number of suitable ways the following is exemplary of the knitting specifications for one preferred panty liner 140 construction:

A jersey fabric was knitted on a Monarch circular knitting machine, available from Monarch Knitting Machine Corporation of Monroe, N.C. The machine is set up with a 22 inch knitting head and knits at 50 rpm. The yarn placement is setup so that two feeds of a 30/1 HYDROTEC yarns are knitted, followed by two feeds of an 18/1 HYDROTEC yarn, followed by two feeds of 30/1 HYDROTEC, and so on. The top and bottom tape settings are set at 170 inches per revolution, and a quality wheel setting of 162. This yields a knitted griege fabric having a weight of about 4.37 ounces per square yard, with 40 stitches per inch and a wale count of 32.

Once knitted, the panty liner fabric may be treated with a chemical finish to enhance the hydrophilic properties and to provide a soil release and anti-microbial treatment. As will be appreciated, the crotch area is particularly susceptible to microbial attack. One chemical finish that been found to provide both a soil release and an anti-microbial treatment is available from Clariant of Mount Holly, N.C., as finish No. T96-21. T96-21 is a sanitized finish that is jet applied in a 1 percent solution. Thereafter, the treated fabric is padded with water, dried, and folded.

In addition to the ribbed structure of the knitted fabric, the inventor has found that the panty liner 140 described herein also provides a comfortable fit and soft touch (good hand) in the crotch area. Referring again to FIG. 6, the ribbed structure and channels are formed substantially on the face 142 of the fabric, while the back 141 of the fabric, shown in FIG. 6, has a substantially flatter, smoother surface.

Figure 11:
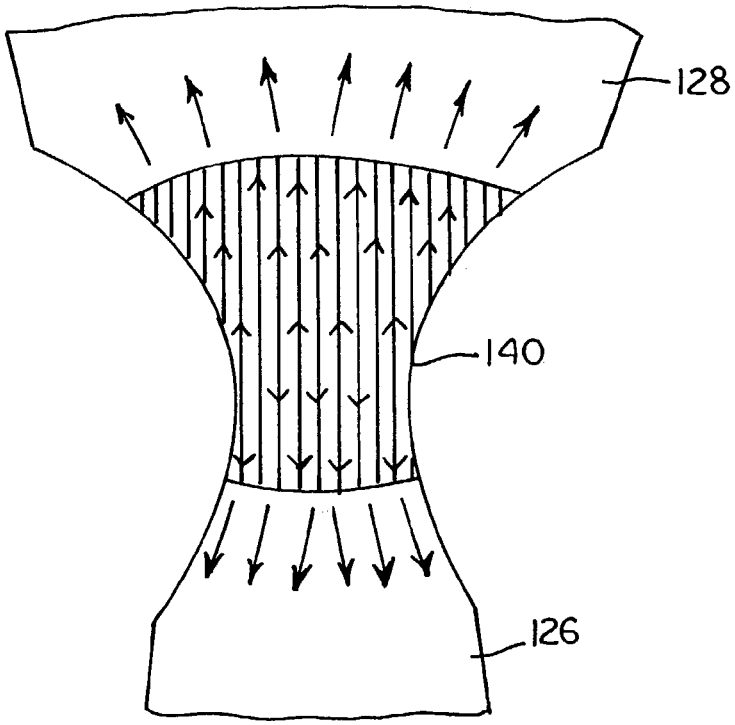
FIG. 11 illustrates the manner in which the panty liner of the present invention disperses moisture.

When placed over the crotch section 130, the panty liner is oriented so that the flat surface 142 is positioned toward the wearer, and the ribbed side 141 is positioned away from the wearer, but in contact with the crotch section 130. Placed in this manner, moisture is wicked downwardly (FIG. 6) through the panty liner 140 and into the channeling structure formed by the alternating pairs of knitted yarns. In addition to placement of the respective surfaces 141, 142, the orientation of the panty liner 140 further improves moisture control and management. As shown in FIG. 7, the knitted fabric 700 is cut and formed into the panty liner 140 so that the ribs (courses) are oriented along the major axis Y—Y. As better seen in FIG. 11, when oriented with the ribs parallel to the major axis, moisture is transported longitudinally toward and into either the front 126 or back 128 sections of the body 120 of the panty. It has been found that water will travel vertically at least about 1 inch along the major axis of the panty liner 140 in less than about 1 minute. As will be apparent from the construction of the panty 100, the front 126 and back 128 sections provide a substantial dispersal field for moisture transported away from the crotch. The moisture is able to spread out into the cotton panels 126, 128 of the panty body, where evaporation is enhanced by the larger surface area.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A panty construction having improved moisture management, comprising:

(a) a body portion defining:

(i) a waist opening at its top and a pair of leg openings;

(ii) a front section and a back section;

(iii) a crotch section joining the front and back sections and defining a major axis therebetween, the crotch section having inner and outer surfaces, opposed side edges and opposed front and back edges;

(b) a panty liner having an inner surface and an outer surface, opposed side edges, and opposed front and back edges, the panty liner formed from a knitted fabric comprising:

(i) alternating courses of hydrophilic synthetic yarns, the alternating courses comprising yarns of different sizes;

(ii) so knitted to form a rib knit with parallel ribs, the parallel ribs formed parallel to the alternating courses; and (c) wherein the panty liner overlies and is attached to the inner surface of the crotch area so that the parallel ribs are substantially parallel with the major axis of the crotch area.

2. The panty construction of claim 1 wherein the body portion is knitted.

3. The panty construction of claim 2 wherein the knitted body portion is formed of yarns selected from the group consisting of cotton, polyester, nylon, rayon, and combinations thereof.

4. The panty construction of claim 1 wherein the hydrophilic yarns are polyester.

5. The panty construction of claim 1 wherein the hydrophilic yarns are selected from the group consisting of filamentary yarns, spun yarns, and combinations or blends thereof.

6. The panty construction of claim 3 wherein the polyester yarn is a multi-filament yarn having at least one moisture channel formed along the length of the yarn.

7. The panty construction of claim 3 wherein the polyester yarn is spun from staples of hydrophilic filaments.

8. The panty construction of claim 1 wherein the parallel rib knit includes a plurality of courses and wales that comprise:

(a) alternating first and second pairs of hydrophilic yarns;

(b) each of the first and second pairs comprising yarns of similar size, the yarns of the first pair being larger than the yarns of the second pair; and (c) wherein the yarns of the second pair form the parallel ribs of the panty liner.

9. The panty construction of claim 8 wherein the alternating first and second pairs of yarns are knitted so that the parallel ribs are substantially parallel to the wales of the knitted fabric.

10. The panty construction of claim 1 wherein the inner surface of the panty liner is substantially smooth, and the outer surface is substantially ribbed.

11. The panty construction of claim 1 wherein the hydrophilic yarns have an anti-microbial finish.

12. The panty construction of claim 1 wherein the panty liner is circular knitted.

13. The panty construction of claim 1 wherein the panty liner is warp knitted.

14. The panty construction of claim 1 wherein water will travel at least about 1 inch along the major axis of the panty liner in less than about 1 minute.

15. A panty liner for improved moisture management, comprising:

(a) an inner surface and an outer surface, opposed side edges, and opposed front and back edges defining a major axis therebetween, the panty liner formed from a knitted fabric comprising:

(i) alternating courses of yarns of hydrophilic synthetic material the alternating courses comprising yarns of different sizes;

(ii) so knitted to form a rib knit with parallel ribs; and (b) wherein the parallel ribs are substantially parallel with the major axis.

16. The panty liner of claim 15 wherein the yarns are polyester.

17. The panty liner of claim 15 wherein the hydrophilic yarns are selected from the group consisting of filamentary yarns, spun yarns, and combinations or blends thereof.

18. The panty liner of claim 16 wherein the polyester yarn is a multi-filament yarn having at least one moisture channel formed along the length of the yarn.

19. The panty liner of claim 16 wherein the polyester yarn is spun from staples of hydrophilic filaments.

20. The panty liner of claim 15 wherein the parallel rib knit includes a plurality of courses and wales that comprise:

(a) alternating first and second pairs of hydrophilic yarns;

(b) each of the first and second pairs comprising yarns of similar size, the yarns of the first pair being larger than the yarns of the second pair; and (c) wherein the yarns of the second pair form the parallel ribs of the panty liner.

21. The panty liner of claim 19 wherein the alternating first and second pairs of yarns are knitted so that the parallel ribs are substantially parallel to the wales of the knitted fabric.

22. The panty liner of claim 15 wherein the inner surface of the panty liner is substantially smooth, and the outer surface is substantially ribbed.

23. The panty liner of claim 15 wherein the hydrophilic yarns have an anti-microbial finish.

24. The panty liner of claim 15 wherein the panty liner is circular knitted.

25. The panty liner of claim 15 wherein the panty liner is warp knitted.

26. The panty liner of claim 15 wherein water will travel at least about 1 inch along the major axis of the panty liner in less than about 1 minute.

27. A method for forming a panty having improved moisture management properties, the method comprising the steps of:

forming from a fabric a panty body portion defining:

(i) a waist opening at its top and a pair of leg openings;

(ii) a front section and a back section;

(iii) a crotch section joining the front and back sections and defining a major axis therebetween, the crotch section having inner and outer surfaces, opposed side edges and opposed front and back edges;

forming a panty liner having an inner surface and an outer surface, opposed side edges, and opposed front and back edges, the panty liner formed from a knitted fabric comprising:

(i) alternating courses of hydrophilic synthetic yarns, the alternating courses comprising yarns of different sizes;

(ii) so knitted to form a rib knit with parallel ribs; and attaching the panty liner to the inner surface of the crotch area so that the parallel ribs are substantially parallel with the major axis of the crotch area.

28. The method of claim 27 wherein the fabric of the body portion is knitted.

29. The method of claim 28 wherein the knitted body portion is formed of yarns selected from the group consisting of cotton, polyester, nylon, rayon, and combinations thereof.

30. The method of claim 27 wherein the hydrophilic yarns are polyester.

31. The panty construction of claim 27 wherein the hydrophilic yarns are selected from the group consisting of filamentary yarns, spun yarns, and combinations or blends thereof.

32. The method of claim 30 wherein the polyester yarn is a multi-filament yarn having at least one moisture channel formed along the length of the yarn.

33. The method of claim 30 wherein the polyester yarn is spun from staples of hydrophilic filaments.

34. The method of claim 27 wherein the parallel rib knit includes a plurality of courses and wales that comprise:

(a) alternating first and second pairs of hydrophilic yarns;

(b) each of the first and second pairs comprising yarns of similar size, the yarns of the first pair being larger than the yarns of the second pair; and (c) wherein the yarns of the second pair form the parallel ribs of the panty liner.

35. The method of claim 34 wherein the alternating first and second pairs of yarns are knitted so that the parallel ribs are substantially parallel to the wales of the knitted fabric.

36. The method of claim 27 wherein the inner surface of the panty liner is substantially smooth, and the outer surface is substantially ribbed.

37. The method of claim 27 wherein the panty liner is circular knitted.

38. The method of claim 27 wherein the panty liner is warp knitted.

* * * * *